US011653438B2

(12) United States Patent
Lo et al.

(10) Patent No.: US 11,653,438 B2
(45) Date of Patent: May 16, 2023

(54) DROPLET COLLECTING SYSTEM AND METHOD OF USING THE SAME

(71) Applicant: TAIWAN SEMICONDUCTOR MANUFACTURING COMPANY LTD., Hsinchu (TW)

(72) Inventors: Yu-Fa Lo, Kaohsiung (TW); Ming-Hsun Tsai, Hsinchu (TW); Shang-Chieh Chien, New Taipei (TW)

(73) Assignee: TAIWAN SEMICONDUCTOR MANUFACTURING COMPANY LTD., Hsinchu (TW)

( * ) Notice: Subject to any disclaimer, the term of this patent is extended or adjusted under 35 U.S.C. 154(b) by 144 days.

(21) Appl. No.: 17/351,225

(22) Filed: Jun. 18, 2021

(65) Prior Publication Data

US 2022/0408537 A1 Dec. 22, 2022

(51) Int. Cl.
*H05G 2/00* (2006.01)

(52) U.S. Cl.
CPC ..... *H05G 2/003* (2013.01); *H05G 2/008* (2013.01)

(58) Field of Classification Search
CPC ..... H05G 2/003; H05G 2/005; H05G 2/006; H05G 2/008; G03F 7/2004; G03F 7/2008; G03F 7/70916; G03F 7/70033; G03F 7/2041; G03F 7/70325
See application file for complete search history.

(56) References Cited

U.S. PATENT DOCUMENTS

| | | | | |
|---|---|---|---|---|
| 8,764,995 | B2 | 7/2014 | Chang et al. | |
| 8,796,666 | B1 | 8/2014 | Huang et al. | |
| 8,828,625 | B2 | 9/2014 | Lu et al. | |
| 8,841,047 | B2 | 9/2014 | Yu et al. | |
| 8,877,409 | B2 | 11/2014 | Hsu et al. | |
| 9,093,530 | B2 | 7/2015 | Huang et al. | |
| 9,184,054 | B1 | 11/2015 | Huang et al. | |
| 9,256,123 | B2 | 2/2016 | Shih et al. | |
| 9,529,268 | B2 | 12/2016 | Chang et al. | |
| 9,548,303 | B2 | 1/2017 | Lee et al. | |
| 11,528,798 | B2 * | 12/2022 | Tu | H05G 2/005 |

FOREIGN PATENT DOCUMENTS

| | | | | |
|---|---|---|---|---|
| CN | 109507849 A | * | 3/2019 | G03F 7/2004 |

* cited by examiner

*Primary Examiner* — David E Smith
*Assistant Examiner* — Hsien C Tsai
(74) *Attorney, Agent, or Firm* — WPAT Law; Anthony King

(57) ABSTRACT

An EUV light source module includes an EUV vessel, a collector disposed in the EUV vessel, a droplet generator, a droplet catcher, and a droplet collecting system. The droplet generator is coupled to the EUV vessel and configured to provide a plurality of target droplets into the EUV vessel. The droplet catcher is coupled to the EUV vessel and configured to catch at least a target droplet from the EUV vessel. The droplet colleting system is coupled to the droplet catcher. The droplet collecting system includes a connecting port coupled to the droplet catcher, and a thermal insulating device surrounding the droplet catcher. The droplet generator and the droplet catcher are disposed at opposite locations in the EUV vessel.

20 Claims, 7 Drawing Sheets

DROPLET COLLECTING SYSTEM AND METHOD OF USING THE SAME

BACKGROUND

The semiconductor industry has experienced rapid growth, due in part to ongoing improvements in the integration density of a variety of electronic components (e.g., transistors, diodes, resistors, capacitors, etc.). For the most part, improvements in integration density have resulted from iterative reduction of minimum feature size, which allows more components to be integrated into a given area. This scaling down has introduced increased complexity to the semiconductor manufacturing process.

As one example, photolithography processes may use a photomask (also referred to as a reticle) to optically transfer patterns onto a substrate. The minimum feature size that may be patterned by way of such a lithography process is limited by a wavelength of its projected radiation source. In view of such limitation extreme ultraviolet (EUV) radiation sources and lithography processes have been introduced.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
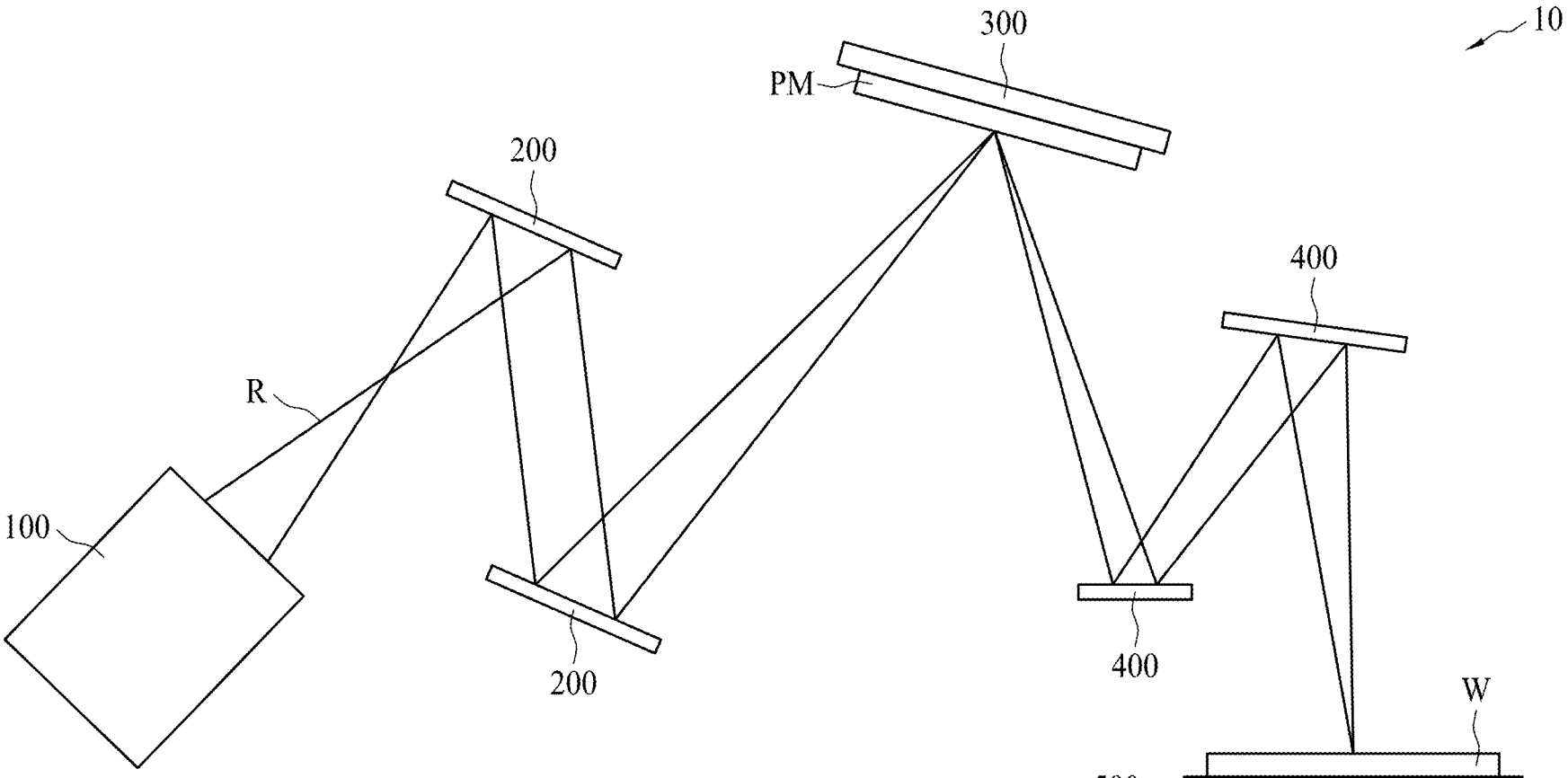
FIG. 1 is a schematic view of an EUV lithography system according to aspects of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

This description of illustrative embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present disclosure. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected" refer to a relationship wherein structures are secured or attached to one another either directly or indirectly through intervening structures, as well as both movable or rigid attachments or relationships, unless expressly described otherwise. Moreover, the features and benefits of the disclosure are illustrated by reference to the embodiments. Accordingly, the disclosure expressly should not be limited to such embodiments illustrating some possible non-limiting combination of features that may exist alone or in other combinations of features; rather, the scope of the disclosure shall be defined by the claims appended hereto.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in the respective testing measurements. Also, as used herein, the terms "substantially," "approximately" or "about" generally mean within a value or range that can be contemplated by people having ordinary skill in the art. Alternatively, the terms "substantially," "approximately" or "about" mean within an acceptable standard error of the mean when considered by one of ordinary skill in the art. People having ordinary skill in the art can understand that the acceptable standard error may vary according to different technologies. Other than in the operating/working examples, or unless otherwise expressly specified, all of the numerical ranges, amounts, values and percentages such as those for quantities of materials, durations of times, temperatures, operating conditions, ratios of amounts, and the likes thereof disclosed herein should be understood as modified in all instances by the terms "substantially," "approximately" or "about." Accordingly, unless indicated to the contrary, the numerical parameters set forth in the present disclosure and attached claims are approximations that can vary as desired. At the very least, each numerical parameter should be construed in light of the number of reported significant digits and by applying ordinary rounding techniques. Ranges can be expressed herein as being from one endpoint to another endpoint or between two endpoints. All ranges disclosed herein are inclusive of the endpoints, unless specified otherwise.

The advanced lithography process, method, and materials described in the current disclosure can be used in many applications, including fin-type field effect transistors (FinFETs). For example, the fins may be patterned to produce a relatively close spacing between features, for which the above disclosure is well suited. In addition, spacers used in forming fins of FinFETs can be processed according to the above disclosure.

As the minimum feature size of semiconductor integrated circuits (ICs) has continued to shrink, great interest has been shown in photolithography systems and processes using radiation sources providing smaller wavelengths. In view of this, extreme ultraviolet (EUV) radiation sources, processes, and systems have been introduced. However, EUV lithography systems, which utilize reflective rather than conventional refractive optics, are very sensitive to contamination issues. In one example, particle contamination introduced onto surfaces of an EUV vessel (e.g., within which EUV light is generated) can result in degradation of various components of the EUV vessel.

Types of contamination in the EUV lithography system may include particles, ions, radiation, and debris deposition. In particular, metal debris, such as tin (Sn) debris, is a common form of contamination of an EUV collector in the EUV vessel.

The present disclosure therefore provides a droplet collecting system and a method for using the same. The droplet collecting system collects droplets used in an EUV lithography system. In some embodiments, the droplet collecting system includes a droplet catcher coupled to an EUV light source module, a connection port coupled to the droplet catcher, and a thermal insulating device enveloping the connection port. The thermal insulation device is utilized to reduce heat dissipation, thus improving droplet collection efficiency.

Please refer to FIG. 1, wherein FIG. 1 is a schematic view of an EUV lithography system 10 according to aspects of the present disclosure. The EUV lithography system 10 may be referred to as a scanner that is operable to perform lithographic processes including exposure. In some embodiments, the lithography processes are performed using EUV radiation R. In some embodiments, the EUV lithography system 10 includes an EUV light source module 100, which is configured to generate the EUV radiation R. For example, the EUV radiation R may have a wavelength between about 1 nm and about 100 nm, and particularly, about 13.5 nm. The EUV lithography system 10 employs an EUV photomask PM, as mentioned above, to reflect the EUV radiation R. Hence, the circuitry pattern on the EUV photomask PM may be precisely duplicated onto a target wafer W by exposing a photoresist on the target wafer W to the EUV radiation R.

In some embodiments, the EUV lithography system 10 includes an illuminator 200. The illuminator 200 includes a variety of optic components, such as a refractive optics system having multiple lenses and/or a reflective optics system having multiple mirrors, so as to direct the EUV radiation R from the EUV light source module 100 toward a mask stage 300, on which the EUV photomask PM is held. Additionally, the mask stage 300 is configured to secure the EUV photomask PM. In some embodiments, the mask stage 300 is an electrostatic chuck (also known as an S-chuck or an R-chuck), which may hold the EUV photomask PM through an attraction force therebetween. Since even a gas molecule may absorb the EUV radiation R and reduce its intensity, the EUV lithography system 10 is designed to be positioned in a vacuum environment to avoid intensity loss of the EUV radiation R. The electrostatic chuck utilizes only the attraction force to hold the EUV photomask PM, such that the use of the electrostatic chuck does not result in presence of particles or gas molecules.

In the disclosure, the terms mask, photomask, and reticle are used to refer to the same item. The EUV photomask PM includes a substrate with a suitable material, such as a low thermal expansion material (LTEM) or fused quartz. The LTEM may include $TiO_2$ doped SiO2, or other suitable materials with low thermal expansion. The EUV photomask PM includes multiple reflective multi layers (ML) deposited on the substrate. The ML includes a plurality of film pairs, such as molybdenum-silicon (Mo/Si) film pairs (e.g., a layer of molybdenum above or below a layer of silicon in each film pair). In some embodiments, the ML may include molybdenum-beryllium (Mo/Be) film pairs, or other suitable materials that are configurable to efficiently reflect the EUV light. The EUV photomask PM may further include a capping layer, such as ruthenium (Ru), disposed on the ML for protection. The EUV photomask PM further includes an absorption layer, such as a tantalum boron nitride (TaBN) layer, deposited over the ML. The absorption layer is patterned to define a pattern of a layer of an integrated circuit (IC). Alternatively, another reflective layer may be deposited over the ML and is patterned to define a pattern of layer of an integrated circuit, thereby forming an EUV phase shift mask.

In some embodiments, the EUV lithography system 10 includes a projection optics module 400 (also known as a projection optics box (POB)). The projection optics module 400 is configured to transfer the circuitry pattern of the EUV photomask PM onto the target wafer W, secured by a wafer stage 500, after the EUV radiation R is reflected by the EUV photomask PM. The projection optics module 400 includes a variety of refractive optics and/or reflective optics arranged based on various designs. The EUV radiation R, which is reflected by the EUV photomask 100 and carries the circuitry pattern defined on the EUV photomask PM is directed toward the target wafer W by the projection optics module 400. Hence, due to the configurations of the illuminator 200 and the projection optics module 400, the EUV radiation R may be focused on the EUV photomask PM and the target wafer W with suitable traits, such as intensity and clearness.

Figure 2:
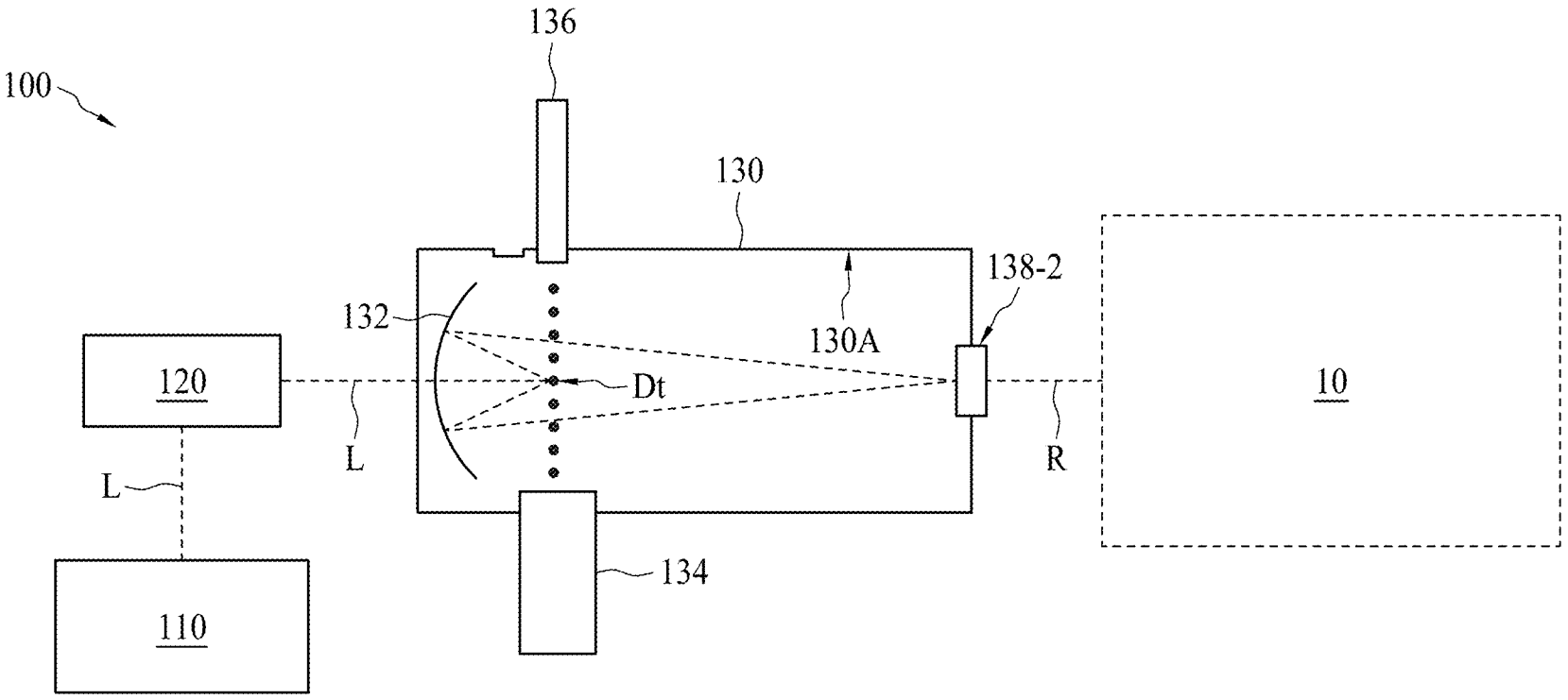
FIG. 2 is a schematic view of an EUV light source according to aspects of the present disclosure.

Please refer to FIG. 2, which is a schematic drawing illustrating an EUV light source module 100 according to aspects of the present disclosure. In some embodiments, the EUV light source module 100 may include a laser produced plasma (LPP) EUV light source. Thus, as shown FIG. 2 and in some embodiments, the EUV light source module 100 may include a pulsed laser source 110 that generates and amplifies a high-power laser beam L (e.g., a $CO_2$ laser beam). The laser beam L may then be directed, by a beam transport and focusing system 120, to an EUV vessel 130. Although a $CO_2$ laser source is described, another laser source technology may be used as appropriate.

Figure 3:
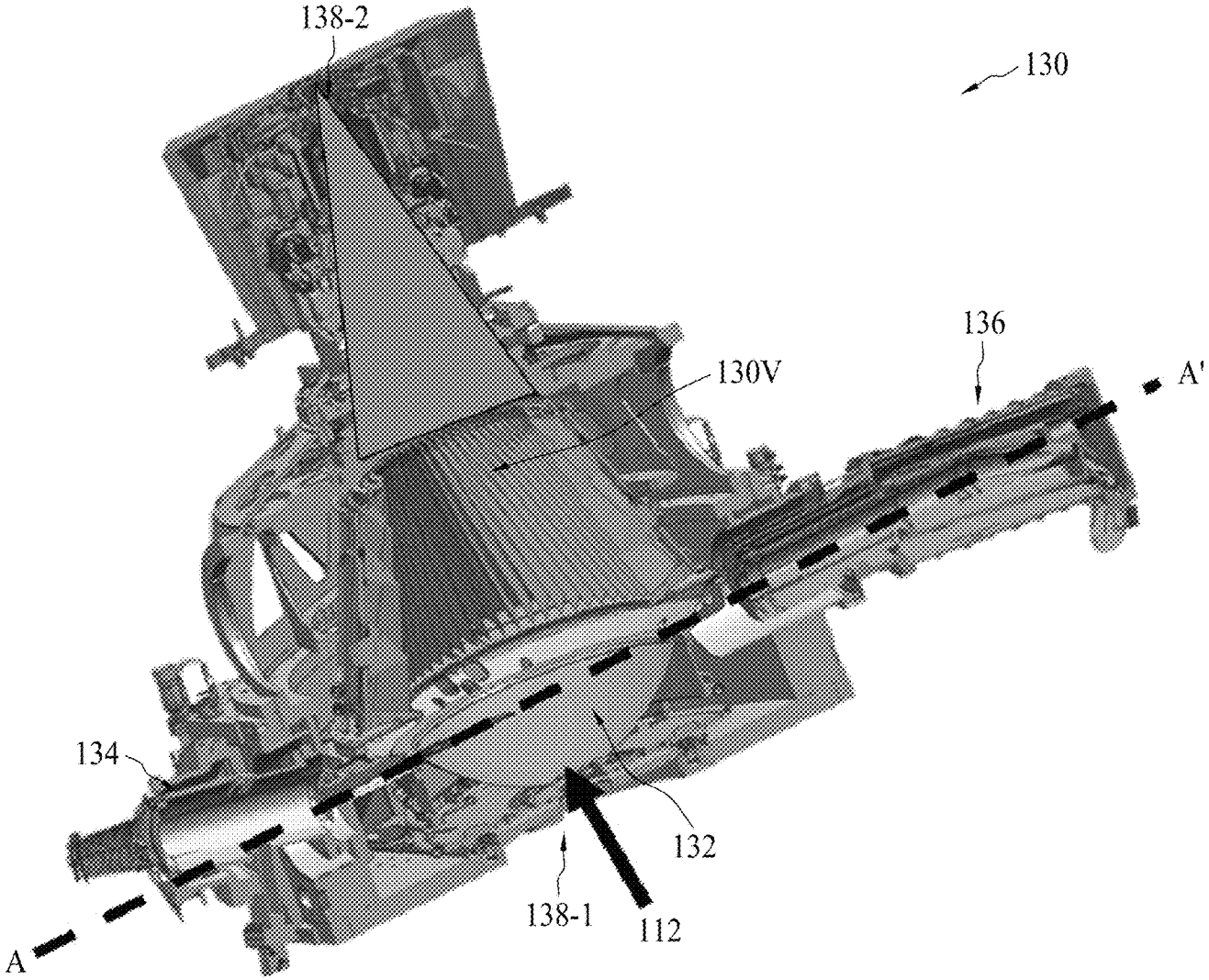
FIG. 3 is a schematic view of an EUV vessel according to aspects of the present disclosure.

Referring to FIGS. 2 and 3, in various embodiments, the EUV vessel 130 includes a collector 132, a droplet generator 134, a droplet catcher 136, an entry point of the laser beam L (i.e., the $CO_2$ laser beam) through a collector aperture 138-1 (shown in FIG. 3), and an EUV radiation output 138-2 from the EUV vessel 130 through an intermediate focus region.

In some embodiments, the EUV vessel 130 may include a plurality of vanes 130V. By way of example, the plurality of vanes 130V may be used to assist in the prevention of source material accumulation (e.g., tin accumulation) on at least some interior surfaces of the EUV vessel 130. Thus, in some cases, each of the plurality of vanes 130V may be heated to a melting point of a material provided by the droplet generator 134 (e.g., tin) such that the melted material may flow (e.g., along a vane fluid channel) into a collection sump. Additionally, while the vanes 130V may help reduce at least some EUV vessel 130 contamination, periodic inspection and maintenance are nevertheless required.

The collector 132 is designed with a proper coating material and shape to function as a mirror for EUV collection, reflection, and focusing. In some embodiments, the collector 132 is designed to have an ellipsoidal geometry. In some embodiments, the coating material of the collector 132 is similar to that of the reflective multilayer of the EUV photomask PM. In some embodiments, the collector 132 may include a normal incidence reflector, for example, implemented as a multilayer mirror (MLM). For example, the collector 132 may include a capping layer (e.g., silicon carbide, SiC) substrate coated with a Mo/Si multilayer. In some cases, one or more barrier layers may be formed at each interface of the MLM, for example, to block thermally-induced interlayer diffusion. In some embodiments, other substrate materials may be used for the collector 132 such as aluminum (Al), Si, or other type of substrate materials. In some embodiments, the collector 132 may further include a grating structure designed to effectively scatter the laser beam directed onto the collector 132. For example, a silicon nitride layer is coated on the collector 132 and is patterned to have a grating. In some embodiments, the laser beam L may pass through and hit droplets generated by the droplet generator 134, thereby producing a plasma at an irradiation region. In some embodiments, the collector 132 may have a first focus at the irradiation region and a second focus at an intermediate focus region. By way of example, the plasma generated at the irradiation region produces EUV radiation R collected by the collector 132 and output from the EUV vessel 130 through the radiation output 138-2. From there, the EUV radiation R may be transmitted to an EUV lithography system 10 as mentioned above. Thus, the EUV lithography system 10 employs the EUV photomask PM to reflect the EUV radiation R, and the circuitry pattern on the EUV photomask PM may be precisely duplicated onto a target wafer W.

As shown in FIGS. 2 and 3, the droplet generator 134 and the droplet catcher 136 are coupled to the EUV vessel 130. The droplet catcher 136 and the droplet generator 134 are disposed or installed at opposite locations in the EUV vessel 130. Further, the droplet generator 134 and the droplet catcher 136 are installed near the collector 132, as shown in FIG. 3. Further, the droplet generator 134 and the droplet catcher 136 may be installed along a direction or about an axis A-A', as shown in FIG. 3, but the disclosure is not limited thereto.

The droplet generator 134 provides target droplets Dt. The target droplets Dt may have at least one material among a group including tin (Sn), tin containing liquid material such as eutectic tin alloy, lithium (Li), xenon (Xe), combinations thereof, and the like. In some embodiments, the target droplet Dt may have a diameter of about 30 microns (μm), but the disclosure is not limited thereto. In some embodiments, the target droplets Dt are generated one at a time with substantially the same period between two consecutive target droplets Dt. In some embodiments, the droplet generator 134 includes a gas supplier (not shown). The gas supplier is configured to supply a pumping gas to force target material out of the droplet generator 134 and drive the flowing of the target droplets Dt. A flow velocity of the target droplets Dt from the droplet generator 134 is controlled by the controller 132. Furthermore, the flow velocity of the target droplets Dt from the droplet generator 134 is a function of the pressure of the pumping gas in the droplet generator 134. For example, the target droplets Dt flow more quickly when the pressure of the pumping gas is increased, and the target droplets Dt flow more slowly when the pressure of the pumping gas is decreased.

Figure 4A:
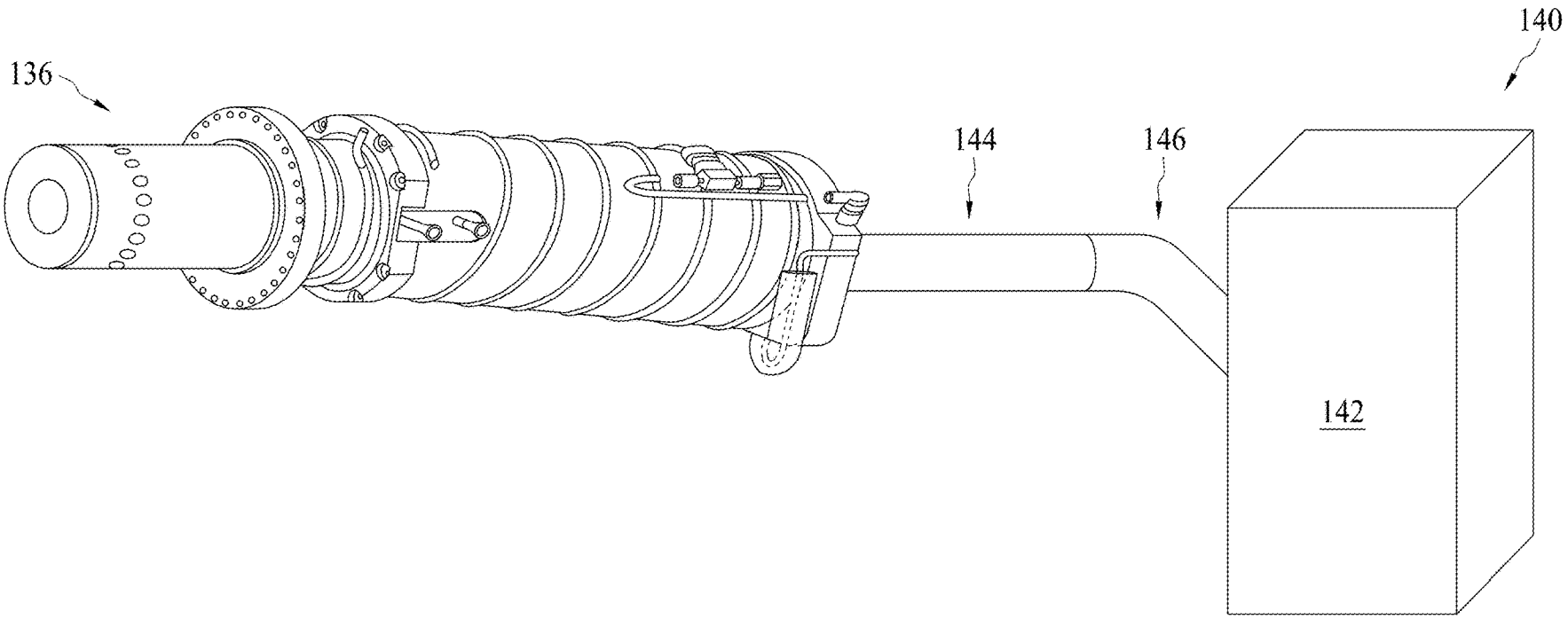
FIG. 4A is a schematic view of a droplet catcher and a droplet collecting system according to aspects of the present disclosure.
Figure 4B:
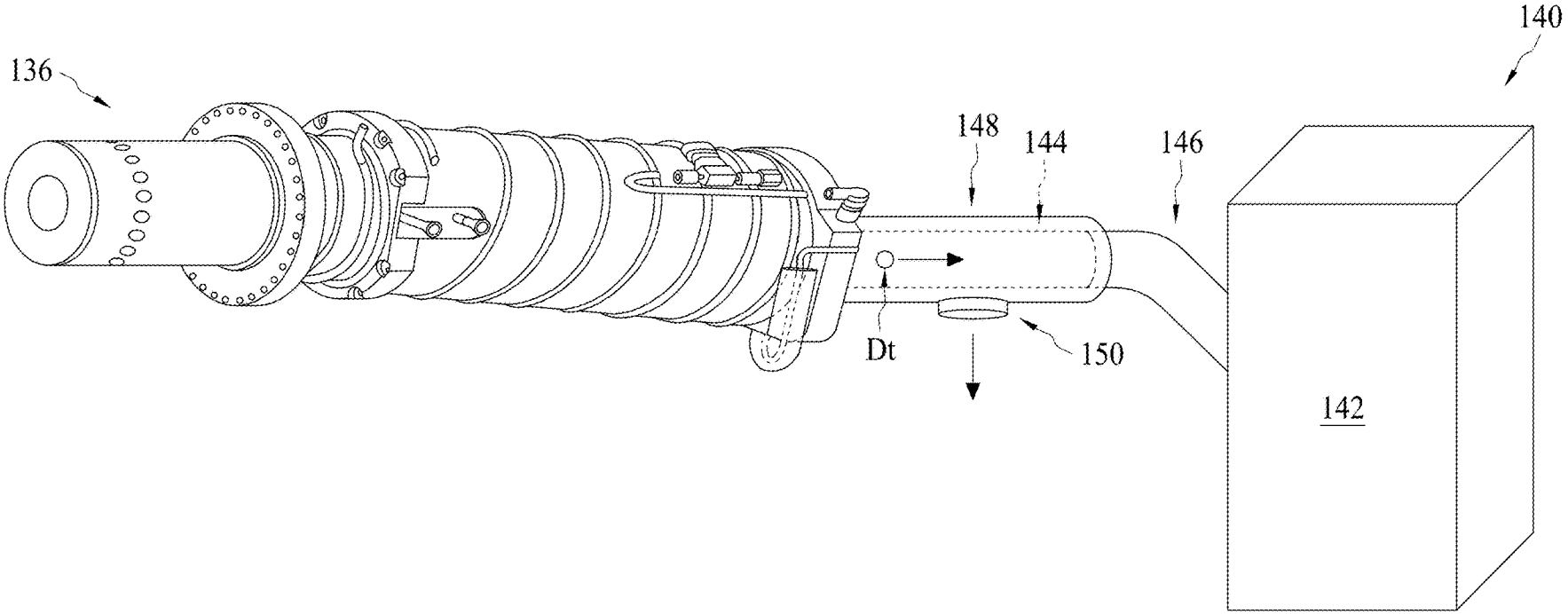
FIG. 4B is a schematic view of a droplet catcher and a droplet collecting system according to aspects of the present disclosure.
Figure 5:
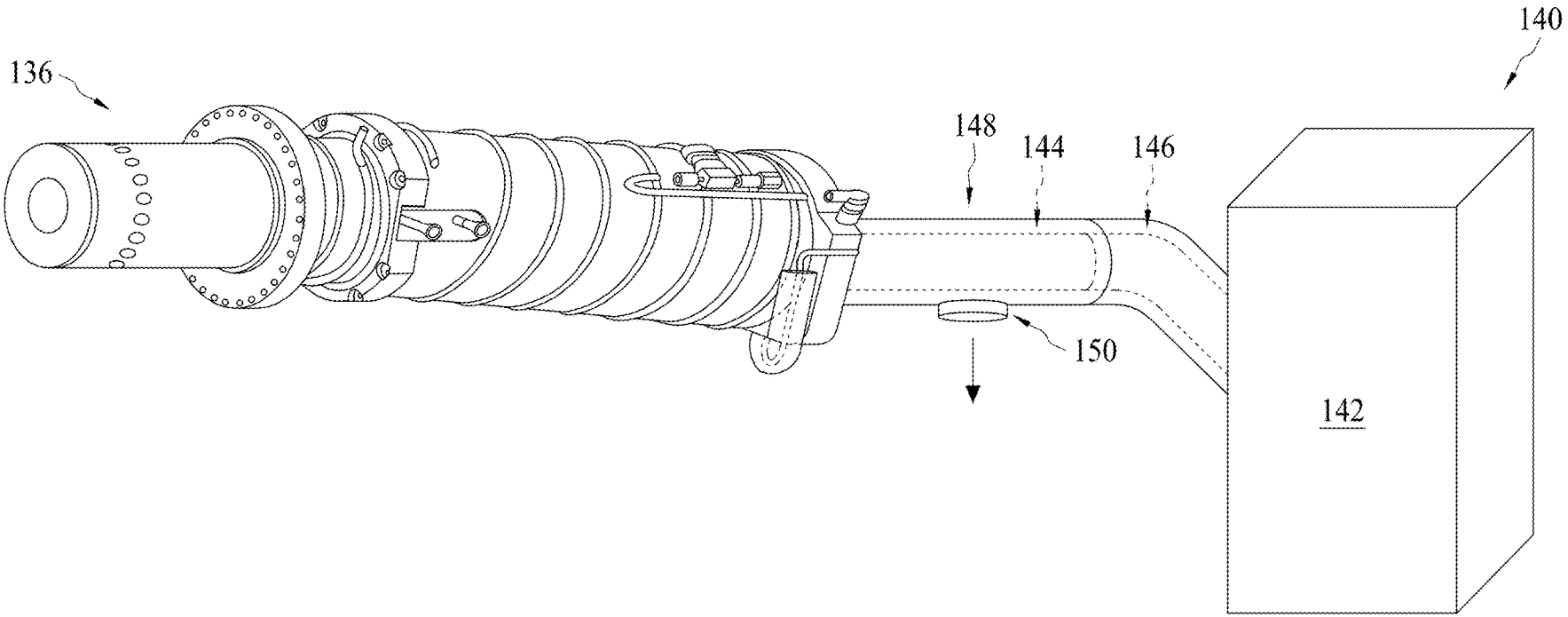
FIG. 5 is a schematic view of a droplet catcher and a droplet collecting system according to aspects of the present disclosure.

The EUV light source module 100 further includes a droplet collecting system 140. In some embodiments, the droplet catcher 136 may be referred to as a part of the droplet collecting system 140. Referring to FIG. 4A, the droplet collecting system 140 includes a droplet storage 142 for storing the target droplet Dt collected from the EUV vessel 130. The droplet collecting system 140 includes a connecting port 144 between the droplet catcher 136 and the droplet storage 142. As shown in FIGS. 4A, 4B and 5, the connecting port 144 is coupled to the droplet catcher 136. In some embodiments, the droplet collecting system 140 includes a conduit 146 coupled to the connecting port 144 and the droplet storage 142.

The droplet collecting system 140 further includes a thermal insulating device 148. In some embodiments, the thermal insulating device 148 is installed to envelop the connecting port 144. In some embodiments, the thermal insulating device 148 includes a thermal insulating material. For example, the thermal insulating device 148 may include polytetrafluoroethylene (PTFE) (also known as Teflon), polyethylene, etc., and may serve as a cover for the connecting port 144.

Referring to FIG. 4B, in some embodiments, the droplet collecting system 140 further includes a vacuum generator 150 coupled to the thermal insulating device 148. In such embodiments, the vacuum generator 150 creates a vacuum environment for the thermal insulating device 148. Further, the connecting port 144 enveloped by the thermal insulating device 148 is therefore disposed in the vacuum environment. It is known that vacuum serves as a high-performance thermal barrier to prevent heat transfer due to thermal conduction and convection. Accordingly, the vacuum environment helps further reduce heat dissipation.

The droplet catcher 136 is used for catching excessive target droplets Dt. For example, some target droplets Dt may be missed by the pulsed laser beam L. In some embodiments, the droplet catcher 136 is heated to a temperature greater than the melting point of tin, e.g., between about 250° C. and about 300° C. In other words, the temperatures of the target droplets Dt in the droplet generator 134, the EUV vessel 130 and the droplet catcher 136 are substantially the same.

Additionally, the high-temperature plasma may cool down and become vapor or small particles (collectively, debris). When the target droplets Dt are not properly and accurately irradiated by the pulsed laser beam L at the lighting position of the excitation zone, debris is increased. For example, if the target droplets Dt are unstable, the unstable target droplets Dt are converted into unstable plasma and undesired debris is present. The debris may be deposited onto the surface of the collector 132, thereby causing contamination of the collector 132. Over time, the reflectivity of the collector 132 degrades due to debris accumulation and other factors such as ion damage, oxidation, and blistering. Once the reflectivity is degraded to a certain degree (e.g., less than 50%), the collector 132 reaches the end of its usable lifespan and needs to be swapped out in a replacement operation. When the collector 132 is swapped out during the replacement operation, the EUV lithography system 10 is shut down, and no lithography exposing process can be performed. As the number of the replacement operations or operation time lost due to the replacement operations is increased, manufacturing cycle time of the target wafer W is increased, thereby increasing manufacturing costs. Therefore, the droplet collecting efficiency is important to the manufacturing cycle time.

In some comparative approaches, the temperature of the target droplet Dt is reduced once it enters the connecting port 144, and thus the target droplet Dt may be deposited on an inner surface of the connecting port 144. In such approaches, the connecting port 144 may become clogged, and thus down time for replacing the clogged connecting port with a new one is required.

In some embodiments, the thermal insulating device 148 and the vacuum generator 150 together help reduce heat dissipation of the droplet collecting system 140. In such embodiments, the temperature of the target droplets Dt in the connecting port 144 remains substantially the same as the temperatures of the target droplet Dt in the droplet catcher 136, the EUV vessel 130 and the droplet generator 134. Accordingly, the droplet deposition issue due to temperature drop in the connecting port 144 is mitigated.

Referring to FIG. 5, in some embodiments, the thermal insulating device 148 also envelops the conduit 146. In some embodiments, the thermal insulating device 148 is in contact with both the connecting port 144 and the conduit 146 to reduce heat dissipation. In such embodiments, the vacuum generator 150 creates a vacuum environment in the thermal insulating device 148. Therefore, the connecting port 144 and the conduit 146 are in the vacuum environment in the thermal insulating device 148. As mentioned above, the thermal insulating device 148 and the vacuum generator 150 together help reduce heat dissipation of the droplet collecting system 140. In such embodiments, the temperatures of the target droplets Dt in the connecting port 144 and the conduit 146 remain substantially the same as the temperatures of the target droplets Dt in the droplet catcher 136, the EUV vessel 130 and the droplet generator 134. Accordingly, the droplet deposition issue due to temperature drop in the connecting port 144 and the conduit 146 is mitigated.

Figure 6:
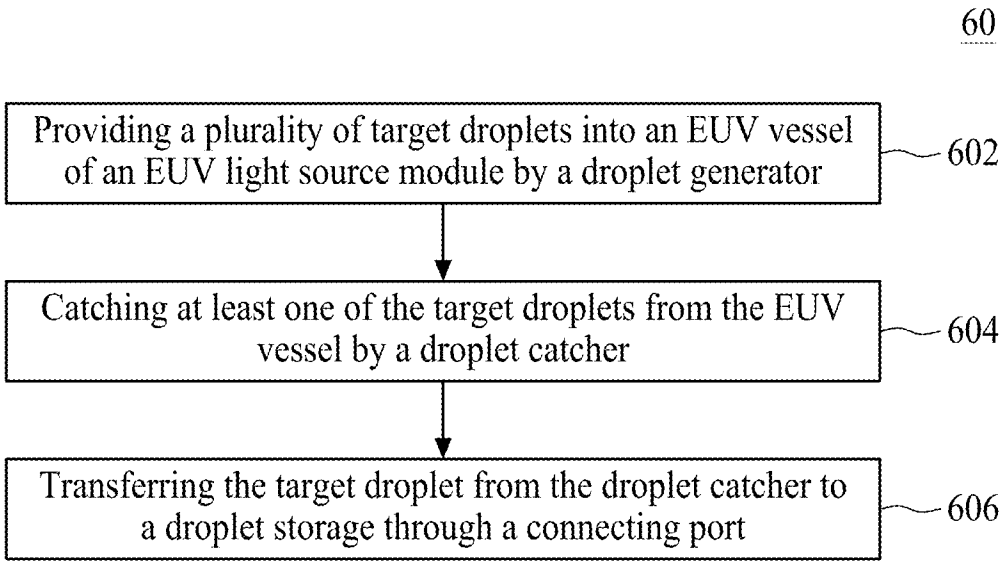
FIG. 6 is a flowchart representing a method of using a droplet collecting system according to aspects of the present disclosure.

Please refer to FIG. 6, which is a flowchart representing a method of using a droplet collecting system 60 according to aspects of the present disclosure. In some embodiments, the method 60 uses a droplet collecting system 140 to collect target droplets (i.e., metal droplets) used in an EUV lithography system 10 as mentioned above. In some embodiments, the method 60 uses the droplet collecting system 140 to collect target droplets from an EUV light source module 100. Further, the method 60 uses the droplet collecting system 140 to collect target droplets from an EUV vessel 130.

In some embodiments, the method 60 includes an operation 602: providing a plurality of target droplets into an EUV vessel of an EUV light source module by a droplet generator. The method 60 further includes an operation 604: catching at least one of the target droplets from the EUV vessel by a droplet catcher. The method 60 further includes an operation 606: transferring the target droplet from the droplet catcher to a droplet storage through a connecting port. The method 60 will be further described according to one or more embodiments. It should be noted that the operations of the method 60 may be rearranged or otherwise modified within the scope of the various aspects. It should further be noted that additional operations may be provided before, during, and after the method 60, and that some other operations may be only briefly described herein. Thus, other implementations are possible within the scope of the various aspects described herein.

Referring to FIGS. 2 and 3, in some embodiments, an EUV photomask PM is loaded and secured by a mask stage 300. In some embodiments an alignment may be performed. The EUV photomask PM includes an IC pattern to be transferred to a semiconductor substrate, such as a target wafer W. In some embodiments, the target wafer W is loaded on a wafer stage 500. The target wafer W may be coated with a resist layer sensitive to an EUV radiation R.

In some embodiments, a lithography process is performed, exposing the target wafer W in the EUV lithography system 10. A high intensity laser, such as a $CO_2$ laser source 110, is enabled, and the droplet generator 134 is also enabled. The laser is pulsed synchronously with the target droplets Dt generated by the droplet generator 134 through a suitable mechanism, such as a control circuit with a timer to control and synchronize the laser source 110 with the droplet generator 134.

In some embodiments, a plurality of target droplets (i.e., metal droplets) are provided into the EUV vessel 130 of an EUV light source module 100 in operation 602. The target droplets Dt are generated by the droplet generator 134. The selection of the material for the target droplets Dt may be made based on a desired wavelength of EUV light produced. In some embodiments, the target droplets Dt are tin droplets and the droplet generator 134 may be referred to as a tin droplet generator. The target droplets Dt are projected across the front of the collector 132 to the droplet catcher 136. In some embodiments, the droplet generator 134 may include a reservoir (not shown), with melted purified tin (or other suitable material) therein, a gas supply line (not shown) for supplying a propulsion gas, such as argon (Ar), a steering system (not shown) for controlling droplet generation, a piezo actuator (not shown) for generating droplets using sonic vibrations, and a nozzle-shroud (not shown), from which the target droplets Dt are projected and shrouded as they enter the EUV vessel 130. The droplet generator 134 may be oriented as illustrated and may produce a horizontal stream of target droplets Dt. The size of the target droplets Dt can vary by design, and the target droplets Dt may have a diameter between about 10 μm and 60 μm. For example, that target droplet Dt may have a diameter of 30 μm as mentioned above, but the disclosure is not limited thereto. Other sizes for the target droplets Dt may be used. The target droplets Dt may be formed at a frequency between about 10 kHz and 100 kHz, such as about 50 kHz. Other droplet frequencies may also be used.

The laser beam L is focused and enters the EUV vessel 130 to hit the target droplets Dt, thereby generating high-temperature plasma. The high-temperature plasma produces the EUV radiation R, which is collected by the collector 132. The collector 132, as mentioned above, reflects and focuses the EUV radiation R for the lithography exposure operations.

As mentioned above, the EUV radiation R is generated in the EUV vessel 130 of the EUV light source module 100, collected by the collector 132, conveyed to illuminate the EUV photomask PM (by the illuminator 200), and further projected onto the resist layer coated on the target wafer W (by the POB 400), thereby forming a latent image on the resist layer.

In some embodiments, to reduce contamination of the components of the EUV vessel 130, a gas shield is produced around the stream of target droplets Dt. When the laser beam L is produced, the EUV radiation R passes through the gas shield unimpeded, but the vaporized tin is kept within the gas shield and directed toward the droplet catcher 136.

Unreacted target droplets Dt (i.e., tin droplets) pass to the droplet catcher 136. For tin droplets which are vaporized, without mitigation the vaporized tin would be homogeneously distributed on the inside of the EUV vessel 130, including on the collector 132 and the vanes 130V, as well as on exposed surfaces of other components of the EUV vessel 130. Tin contaminants on such components reduce the effectiveness of the EUV light source module 100. While some of the components are replaceable, the collector 132 is highly precise and expensive to produce, so contamination of the collector 132 is undesirable. Some components, however, can be reconditioned. For example, the vanes 130V may be heated to melt and recover a material, such as tin, that collects on the vanes 130V.

Referring to FIGS. 3 and 4B, in operation 604, at least one of the target droplets Dt is caught from the EUV vessel 130 by the droplet catcher 136. The droplet catcher 136 catches the target droplets Dt that are generated by the droplet generator 134 but not vaporized by the laser beam L pulsed from the $CO_2$ laser source 110. In some embodiments, a vacuum exhaust system (not shown) may be attached in front of the opening of the droplet catcher 136 to help catch the target droplets Dt. In some embodiments, a negative pressure source may include a vacuum pump or another suitable device for providing a suitable negative pressure. For example, some embodiments may use an Edwards high vacuum iXH dry pumps or an Ebara dry vacuum pump Model EV-M series. Other suitable pumps may be used. In some embodiments, pressure control may be provided by a throttle valve or a pressure control valve.

In some embodiments, as shown in FIGS. 4B and 5, the target droplet Dt is transferred to the droplet storage 142 from the droplet catcher 136 through the connecting port 144 in operation 606. As mentioned above, the target droplet Dt is heated to between approximately 250° C. and approximately 300° C. in the droplet generator 134. The temperature of the target droplets Dt remains substantially the same when the target droplets Dt are introduced into the EUV vessel 130. As mentioned above, the unvaporized target droplets Dt are caught by the droplet catcher 136. It should be noted that the temperature of the target droplets Dt in the droplet catcher 136 remains the same as the temperature of the target droplets Dt in the EUV vessel 130 and the droplet generator 134. Further, the thermal insulating device 148 and the vacuum generator 150 coupled to the thermal insulating device 148 together help reduce heat dissipation, such that the temperatures of the target droplets Dt in the connecting port 144 and the conduit 146 are kept substantially the same as the temperature of the target droplets Dt in the droplet catcher 136.

In some embodiments, the target droplets Dt are collected and stored in the droplet storage 142. In some embodiments, the target droplet Dt may be recycled and reused. In such embodiments, the droplet storage 142 is coupled to the droplet generator 134. The recycled target droplets Dt in the droplet storage 142 are heated to a temperature greater than the melting point of tin, e.g., between about 250° C. and about 300° C., then supplied to the droplet generator 134. In some embodiments, a pressurizing device (not shown) is coupled to the droplet storage 142. In such embodiments, the pressurizing device includes a compressor, a pump, or any other device that can increase a gas pressure. In some embodiments, a facility gas supply (e.g., $N_2$) or a pressurized gas tank with a regulator is used.

In such embodiments, the temperatures of the target droplets Dt in the droplet generator 134, the droplet catcher 136 and the droplet storage 142 are substantially the same. Therefore the connecting port 144 and the conduit 146 may be the weakest passage when transferring the target droplet Dt. In other words, the connecting port 144 and the conduit 146 may be more likely to allow a change in the temperature of the target droplets Dt. According to the method 60, the droplet collecting system 140 is used such that the thermal insulating device 148 and the vacuum generator 150 together help reduce heat dissipation, such that the temperature of the target droplets Dt in the connecting port 144 and the conduit 146 remains the same as the temperature of the target droplets Dt in the droplet catcher 136. Therefore, the droplet deposition in the connecting port 144 (and the conduit 146) may be mitigated.

In summary, the present disclosure provides a droplet collecting system and a method for using the same. The droplet collecting system collects droplets used in an EUV lithography system. In some embodiments, the droplet collecting system include a droplet catcher coupled to an EUV light source module, a connection port coupled to the droplet catcher, and a thermal insulating device surrounding the connection port. The thermal insulation device is utilized to reduce heat dissipation, thus improving droplet collection efficiency.

According to one embodiment of the present disclosure, a droplet collecting system is provided. The droplet collecting system includes a droplet catcher, a droplet storage, a connecting port between the droplet catcher and the droplet storage, and a thermal insulating device surrounding the connecting port and creating a vacuum environment. The connecting port is disposed in the vacuum environment.

According to one embodiment of the present disclosure, an EUV light source module is provided. The EUV light source module includes an EUV vessel, a collector disposed in the EUV vessel, a droplet generator, a droplet catcher, and a droplet collecting system. The droplet generator is coupled to the EUV vessel and configured to provide a plurality of target droplets into the EUV vessel. The droplet catcher is coupled to the EUV vessel and configured to catch at least a target droplet from the EUV vessel. The droplet colleting system is coupled to the droplet catcher. The droplet collecting system includes a connecting port coupled to the droplet catcher and a thermal insulating device surrounding the droplet catcher. The droplet generator and the droplet catcher are disposed at opposite locations in the EUV vessel.

According to one embodiment of the present disclosure, a method is provided. The method includes following operations. A plurality of target droplets is provided into an EUV vessel of an EUV light source module by a droplet generator. At least a target droplet is caught from the EUV vessel by a droplet catcher. The target droplet is transferred from the droplet catcher to a droplet storage through a connecting port. A temperature of the target droplet in the connecting port is similar to a temperature of a target droplet in the droplet catcher.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A droplet collecting system, comprising:

a droplet catcher;

a droplet storage;

a connecting port between the droplet catcher and the droplet storage and coupled to the droplet catcher; and a thermal insulating device surrounding the connecting port and creating a vacuum environment, wherein the connecting port is disposed in the vacuum environment.

2. The droplet collecting system of claim 1, wherein the thermal insulating device comprises a thermal insulating material.

3. The droplet collecting system of claim 1, further comprising a vacuum generator coupled to the thermal insulating device.

4. The droplet collecting system of claim 1, further comprising a conduit coupled to the connecting port and the droplet storage.

5. The droplet collecting system of claim 4, wherein the thermal insulating device surrounds the conduit, and the conduit is disposed in the vacuum environment.

6. The droplet collecting system of claim 1, wherein a temperature in the connecting port is substantially the same as a temperature in the droplet catcher.

7. An extreme ultraviolet (EUV) light source module comprising:

an EUV vessel;

a collector disposed in the EUV vessel;

a droplet generator coupled to the EUV vessel and configured to provide a plurality of target droplets into the EUV vessel;

a droplet catcher coupled to the EUV vessel and configured to receive at least a target droplet from the EUV vessel; and a droplet collecting system coupled to the droplet catcher, wherein the droplet collecting system comprises:

a connecting port coupled to the droplet catcher; and a thermal insulating device surrounding the droplet catcher, wherein the droplet generator and the droplet catcher are disposed at opposite locations in the EUV vessel.

8. The EUV light source module of claim 7, wherein the thermal insulating device of the droplet collecting system comprises a thermal insulating material.

9. The EUV light source module of claim 7, wherein the droplet collecting system further comprises a vacuum generator coupled to the thermal insulating device, wherein the vacuum generator creates a vacuum environment in the thermal insulating device.

10. The EUV light source module of claim 9, wherein the connecting port is disposed in the vacuum environment.

11. The EUV light source module of claim 7, wherein the thermal insulating device is in contact with an external surface of the connecting port.

12. The EUV light source module of claim 7, wherein the droplet collecting system further comprises a droplet storage.

13. The EUV light source module of claim 12, wherein the droplet collecting system further comprises a conduit coupled to the droplet storage and the connecting port, and the conduit is surrounded by the thermal insulating device.

14. The EUV light source module of claim 7, wherein the droplet generator and the droplet catcher are disposed over the collector.

15. The EUV light source module of claim 7, further comprising a laser source.

16. The EUV light source module of claim 7, wherein a temperature of the target droplets in the droplet catcher is similar to a temperature of a target droplet in the EUV vessel.

17. A method, comprising:

providing a plurality of target droplets into an EUV vessel of an EUV light source module by a droplet generator;

catching at least one of the target droplets from the EUV vessel by a droplet catcher; and transferring the target droplet from the droplet catcher to a droplet storage through a connecting port, wherein a temperature of the target droplet in the connecting port is similar to a temperature of a target droplet in the droplet catcher.

18. The method of claim 17, further comprising generating a vacuum environment in a thermal insulating device, wherein the connecting port is disposed in the vacuum environment in the thermal insulating device.

19. The method of claim 18, wherein the transferring of the target droplet from the droplet catcher to the droplet storage comprises transferring the target droplet through a conduit, wherein the conduit is disposed in the vacuum environment of the thermal insulating device.

20. The method of claim 17, further comprising providing the target droplet from the droplet storage to the droplet generator.

* * * * *